US007160121B2

(12) United States Patent
Van Schuylenbergh et al.

(10) Patent No.: US 7,160,121 B2
(45) Date of Patent: Jan. 9, 2007

(54) STRESSED METAL CONTACT WITH ENHANCED LATERAL COMPLIANCE

(75) Inventors: Koenraad F. Van Schuylenbergh, Sunnyvale, CA (US); Christopher L. Chua, San Jose, CA (US); David K. Fork, Los Altos, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 10/737,272

(22) Filed: Dec. 15, 2003

(65) Prior Publication Data

US 2005/0130462 A1 Jun. 16, 2005

(51) Int. Cl.
*H01R 12/00* (2006.01)

(52) U.S. Cl. ..... 439/81

(58) Field of Classification Search ..... 439/81; 324/754; 174/260, 25; 361/776, 764; 438/117, 438/52; 257/668, 690, 692; 435/14, 4
See application file for complete search history.

(56) References Cited

U.S. PATENT DOCUMENTS

| | | | | |
|---|---|---|---|---|
| 3,842,189 | A | 10/1974 | Southgate | 174/52.8 |
| 5,613,861 | A * | 3/1997 | Smith et al. | 439/81 |
| 5,830,782 | A * | 11/1998 | Smith et al. | 438/123 |
| 5,859,472 | A * | 1/1999 | DiStefano et al. | 257/674 |
| 5,913,109 | A * | 6/1999 | Distefano et al. | 438/117 |
| 5,914,218 | A * | 6/1999 | Smith et al. | 430/320 |
| 6,184,053 | B1 * | 2/2001 | Eldridge et al. | 438/52 |
| 6,215,670 | B1 | 4/2001 | Khandros | 361/774 |
| 6,245,444 | B1 * | 6/2001 | Marcus et al. | 428/616 |
| 6,307,161 | B1 * | 10/2001 | Grube et al. | 174/260 |
| 6,361,959 | B1 * | 3/2002 | Beroz et al. | 435/14 |
| 6,439,898 | B1 * | 8/2002 | Chua et al. | 439/81 |
| 6,489,248 | B1 * | 12/2002 | Zhang et al. | 438/714 |
| 2002/0173146 | A1 * | 11/2002 | Fork | 438/652 |
| 2004/0022040 | A1 | 2/2004 | Sitaraman et al. | 361/772 |

OTHER PUBLICATIONS

Lunyu Ma, Qi Zhu, Thomas Hantschel, David Fork, Suresh Sitaraman: J-Springs—Innovative Compliant Interconnects for Next-Generation Packaging, 2002 Electronic Components and Technology Conference, 2002 IEEE, pp. 1359-1365.

* cited by examiner

*Primary Examiner*—Alexander Gilman
(74) *Attorney, Agent, or Firm*—Kent Chen

(57) ABSTRACT

An electrical interconnect structure that includes a spring portion that extends out of a plane. The electrical interconnect including curved regions to improve the lateral compliance of the interconnect. The curved region may be incorporated into a release region of the spring. The release region may include either or both an uplifted region and a planar region. The curves in the release region are arranged to improve the spring contact with a mating surface and also improve lateral compliance compared to prior art spring designs.

36 Claims, 7 Drawing Sheets

FIG. 1
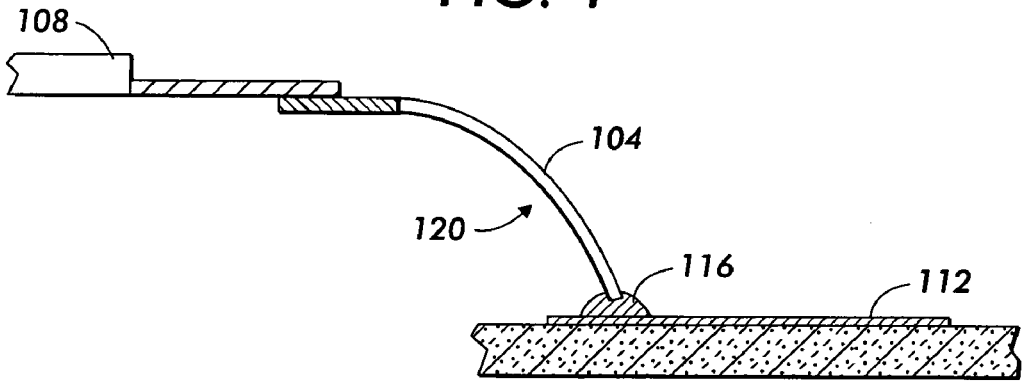
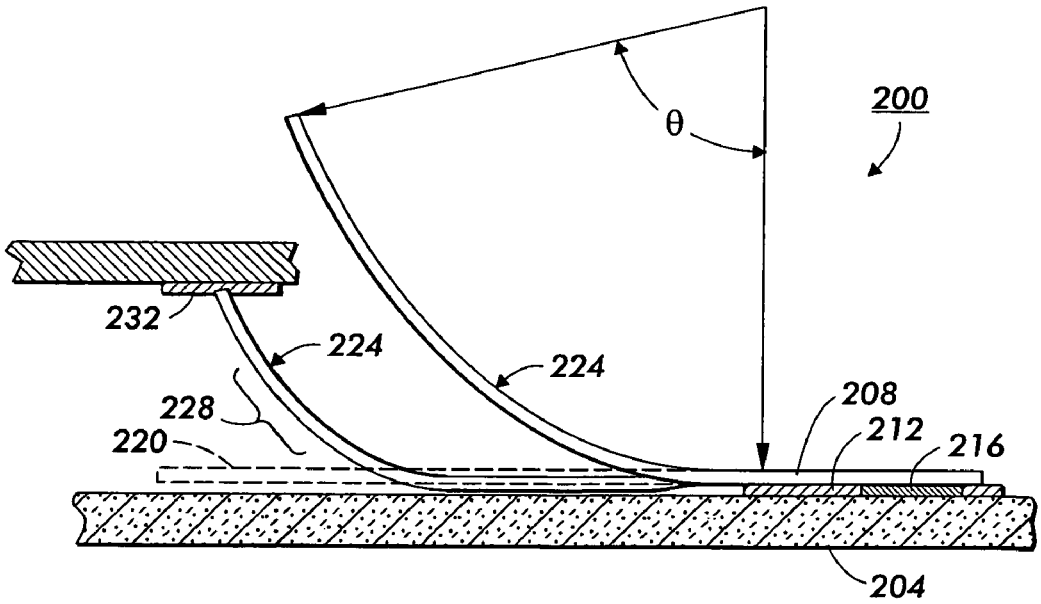
FIG. 2

FIG. 3
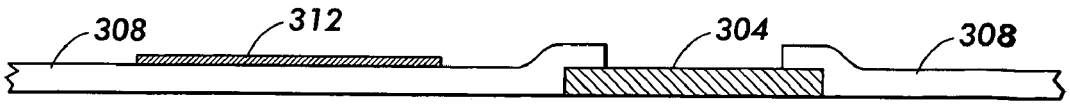
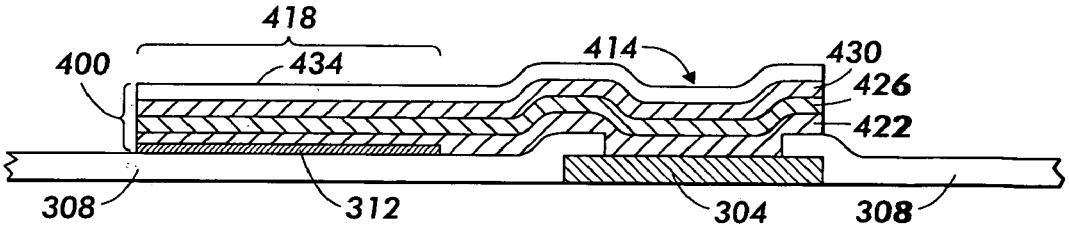
FIG. 4
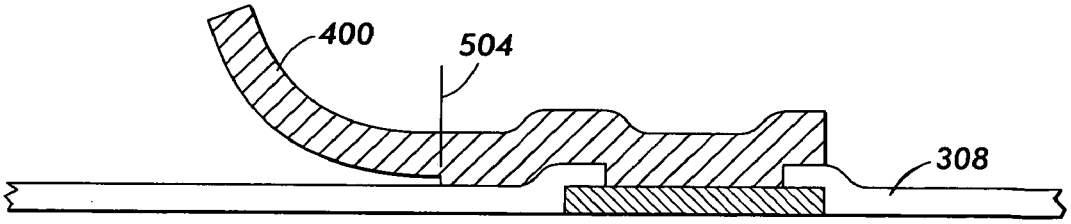
FIG. 5
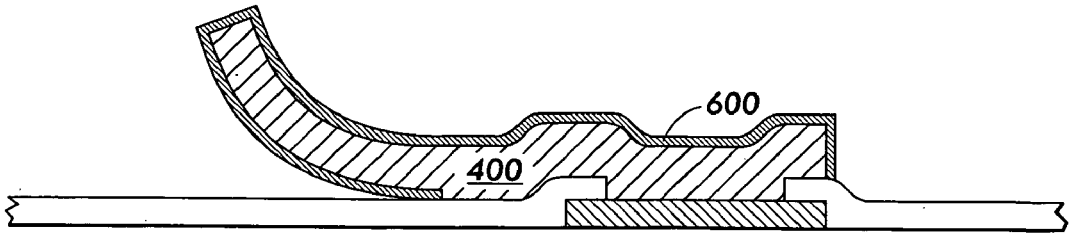
FIG. 6

FIG. 11
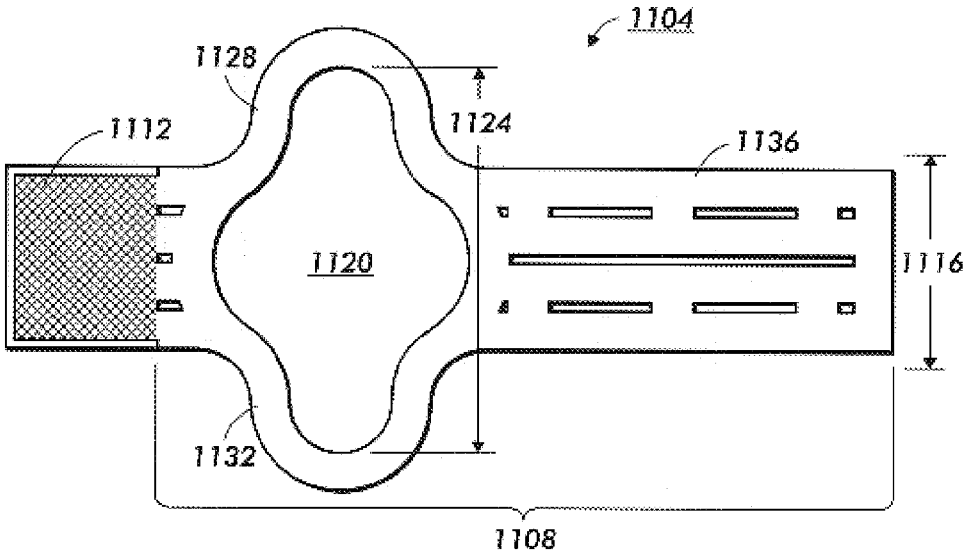
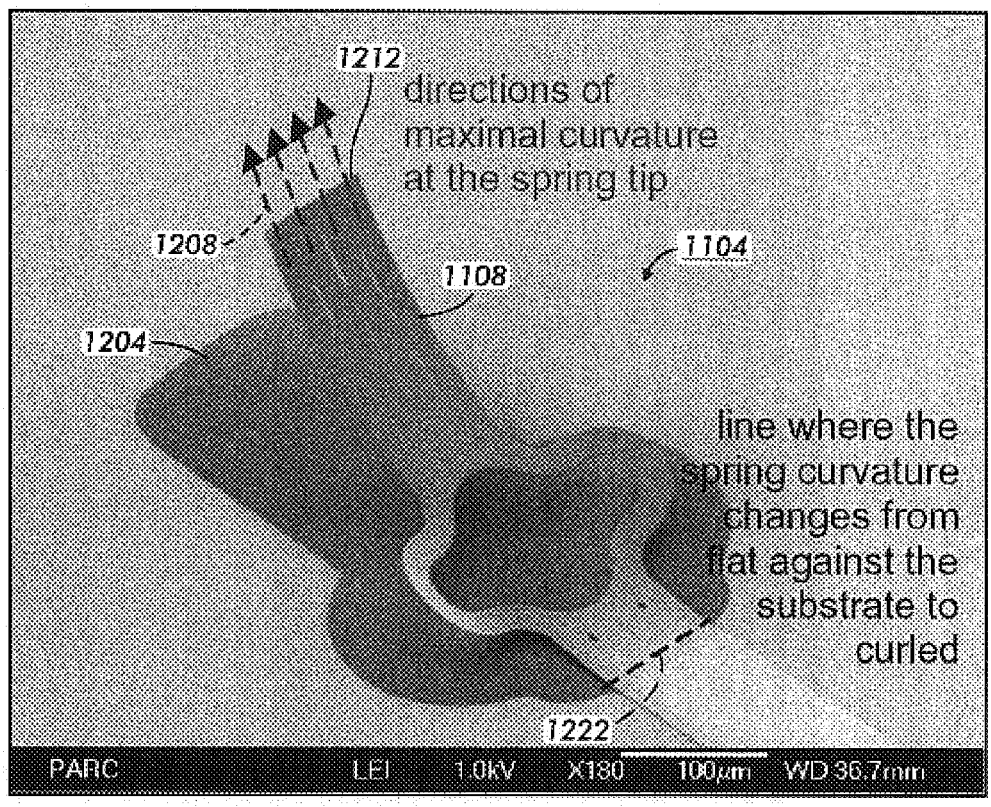
FIG. 12

STRESSED METAL CONTACT WITH ENHANCED LATERAL COMPLIANCE

BACKGROUND

Stressed metal technology has been adapted to fabricate interconnects between small components in a circuit. One example of a common interconnect is a flip-chip interconnect that connects a circuit board to an integrated circuit. These interconnects are usually either mechanically pressed against a circuit board pad or soldered into a circuit board pad.

One problem with such interconnects is that differential rates of thermal expansion between the integrated circuit and the circuit board moves the ends of the interconnects. A mechanical pressed contact can accommodate some of the stresses by sliding over its mating circuit board pad. A soldered contact in which the ends are fixed typically relies on the in-plane spring compliance to handle the movements. However, conventional straight stressed-metal springs, although flexible along their axis, have a rather limited compliance for stresses in a lateral direction, a direction that is perpendicular to the axis of the stressed metal spring.

In response, J-Shaped spring contacts have been developed as described in U.S. patent application Ser. No. 10/443,957, entitled "Multi-Axis Compliance Spring" based on provisional application No. 60/382,602 filed May 24, 2002. The entire document of the patent application and the related provisional application are hereby incorporated by referenced in their entirety. Although the disclosed J spring designs offer improved lateral compliance, the designs use substantial area on an integrated circuit. Furthermore, the design of the J springs make it difficult to route traces around the spring array. Additionally, in J springs that include bends exceeding 90°, the contact point that mates with the circuit board pad, is not the spring tip but rather the J spring outer edge. When the approximately 90 degree point of the outer edge is soldered to the mating board pad, extending the J shape beyond 90° does not provide additional spring compliance.

Thus an improved system that offers enhanced lateral compliance to make interconnects between small circuit elements is needed.

SUMMARY

An electrical circuit interconnect is described. The interconnect includes an anchor portion coupled to a substrate. A flexible stressed metal forming a release portion is coupled to the anchor portion. The release portion includes a tip and at least one curve. The curves in the release portion arranged such that the tip is in a desired orientation.

BRIEF DESCRIPTION OF THE DRAWINGS

FIG. 1 shows a side view of a stressed metal interconnect.

FIG. 2 shows a shows a side view of an interconnect structure disposed on a substrate.

FIG. 3 shows a side view of a release layer deposited over a substrate.

FIG. 4 shows a stressed metal deposited over the release layer.

FIG. 5 removal of the release layer to create an uplift region.

FIG. 6 shows depositing a highly conducting layer over the interconnect structure to improve conductivity of the interconnect structure

FIG. 11 shows a top view of an interconnect structure including a release portion with an aperture.

FIG. 12 shows an angled view of the structure of FIG. 11 that shows a release portion curved out of the plane of the substrate.

DETAILED DESCRIPTION

Figure 7:
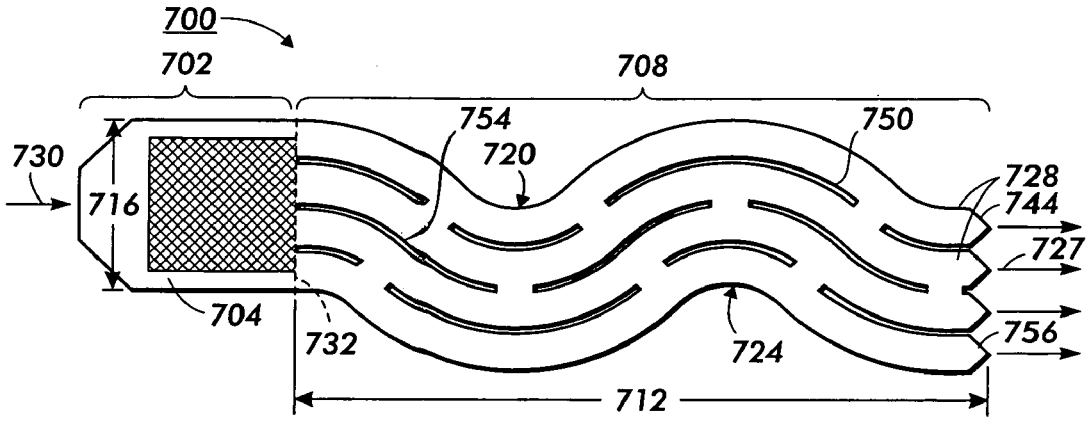
FIG. 7 shows a top view of an interconnect structure including a plurality of curves to enhance lateral compliance.

A structure and method for coupling two electrical elements is described. The structure uses a stressed metal that includes a release portion that includes. at least one in-plane curve. The release portion further includes an uplift portion that may coincide with, or be only a part of the release portion. If the uplift portion includes in-plane curves, the total arc subtended by all in-plane curves in the uplift region totals approximately zero degrees. Clockwise bends are counted positive in this total, counter clockwise bends negative. As used herein, in-plane curves refer to curves that exist in a lateral direction, usually curves that exist in the plane of the substrate prior to removal of a release layer that allows uplifting of the stressed metal. The term "in-plane curve" is used to distinguish from the curvature out of the plane that results from metal stresses.

In-plane curves improve the compliance of the interconnect in a lateral direction reducing the rate of failure among such interconnects when lateral stresses are applied. Keeping the total angle subtended by all in-plane curves in the uplift spring portion to approximately zero degrees helps orient the tip to point away from the substrate. Maintaining a net of 0 degrees of curvature in the uplift portion of the spring also minimizes tip tilt thereby maximizing spring tip contact with the mating circuit board pad. Finally, maintaining a net of 0 degrees curvature in the uplift portion allows the entire spring length to contribute to the spring compliance.

FIG. 1 shows a side view of a stressed metal interconnect 104 used to couple a first circuit element 108 to a second circuit element 112. In the illustrated embodiment, first circuit element 108 is an integrated circuit and second circuit element 112 is a bond pad of printed circuit board. In the illustrated embodiment, solder 116 fixes first circuit element 108 to a first end of stressed metal interconnect 104. Mechanical tension generated by a bend 120 creates a spring action that fixes a second end of metal interconnect 104 to the bond pad.

Stressed metal interconnect 104 may be formed from a variety of materials. As described in U.S. Pat. No. 5,613,861 entitled Photolithographically Patterened Spring Contacts by Donald Smith and Andrew Alimonda and hereby incorporated by reference in its entirety, most often the stressed metal interconnect 104 is formed from materials such as molybdenum, chromium, tungsten, nickel, zirconium or alloys thereof.

FIG. 2 shows a side view of the interconnect structure 200 having disposed on the substrate 204. Typically interconnect structure 200 is either made with a conducting material, or coated or plated with a conductive material. Alternately, interconnect structure 200 may be made with a nonconducting material, and then subsequently coated with a conducting material. A detailed more detailed description of the fabrication of the spring will be provided in the flow chart of FIG. 3.

In the illustrated embodiment interconnect structure 200 has an anchor portion 208 that is fixed to an underlayer 212 and electrically connected to a contact pad 216. Typically, underlayer 212 is a conductive underlayer made from a material such as titanium or other etchable material. The contact pad 216 is often made of a metal such as aluminum, gold, indium, tin oxide, copper, silver, nickel or the like.

The illustration of FIG. 2 shows the interconnect structure in three positions. In initial formation, the interconnect structure is formed in positions 220, where a release portion 224 of interconnect structure 200 attaches to substrate 204. As the material attaching release portion 224 to interconnect structure 200 is etched or otherwise removed, internal stresses cause release portion 224 to form an out of the substrate plane curve 228. The out of plane curve 228 subtends an angle theta. The out of plane curve formed is in a plane approximately perpendicular to the surface of substrate 204.

A second contact pad 232 is brought into contact with release portion 224. Pressure applied by contact pad 232 reduces the curvature of interconnect structure 200. Spring pressure or tension in interconnect structure 200 maintains electrical contact between contact pad 216 coupled to anchor portion of interconnect structure 200 and contact pad 232 coupled to the release portion 224 of interconnect structure 200.

FIGS. 3–6 show one method of forming interconnect structure 200. In FIG. 3, a contact pad 304 is formed over or adjacent to a substrate 308. A release layer 312 is also deposited over substrate 308. Release layer 312 is typically an electrical conductor.

In FIG. 4, a stressed metal layer 400 is deposited on or over substrate 308. The metal may be one of a variety of materials, such as a MoCr alloy. An anchor portion 414 of metal layer 400 couples to anchor pad 304. A release portion 418 of metal layer 400 is deposited over release layer 312. Techniques for depositing metal layer 400 include, but are not limited to electron beam deposition, thermal evaporation, sputter deposition, electroplating and chemical vapor deposition as well as other techniques.

Metal layer 400 includes a plurality of sublayers 422, 426, 430 such that the total plurality of sublayers results in a metal layer 400 approximately 1 micrometer thick. A stress gradient is generated in metal layer 400 by altering the stress inherent in each of the sublayers 422, 426, 430 as each sublayer is formed. There are numerous ways of introducing such stress in the sublayers, including but not limited to adding a reactive gas to a plasma used during sputter deposition, depositing the metal at an angle, and changing the pressure of the plasma during deposition. An example method sputters a metal in a vacuum chamber. As each metal layer is deposited, the pressure within the vacuum chamber is increased causing compressive stress in early deposited layers and tensile stress in later deposited layers. After formation, metal layer 400 has an intrinsic stress that becomes increasingly tensile toward the top of metal layer 400 resulting in a tendency to bend into an arc. However, adhesion with substrate 308 through conductive layer 312 and contact pad 304 keeps metal layer 400 approximately flat.

After deposition of metal layer 400, the metal layer is patterned to form individual interconnect structures. Photolithography represents one method of patterning that is often used in the semiconductor industry. In one embodiment of photolithography, a positive photoresist layer 434 is spun on top of metal layer 400 and soft-baked at approximately 90 degrees C. to drive off solvents in resist layer 434. Certain areas of the metal layer 400 to be removed are masked using a mask pattern. After exposure to a predetermined amount of ultraviolet light, the photoresist is developed. Areas of photoresist that were not masked, and thus were exposed to ultraviolet light are removed during the developing process. The remaining resist layers is hard baked at 120 degrees Centigrade.

Areas of metal layer 400 not protected by photoresist are then removed. One method of such removal is to etch metal layer 400. The areas of metal layer under the remaining photoresist forms the shape of the interconnect, including any curves that may be formed in the release portion 224 of the interconnect structure. FIGS. 7 through 9, 11 and 13 show example top views of the interconnect structure prior to release. The shaded areas indicate the opening in the release photoresist.

After formation of the metal layer 400 shape, the metal layer may be released from conductive underlayer 312. Under-cut etching may be used to release metal layer 400 from substrate 308. The undercut etch is controlled to prevent etching in the anchor region of metal layer 400, this anchor region is coupled to contact pad 304. Examples of undercut etching that enable undercutting of the release region while maintaining coupling with the contact pad were provided in the already incorporated reference Xerox Docket A2175.

After release from conductive underlayer 312, the stress gradient causes the released portion of metal layer 400 to bend up and away from substrate 308. FIG. 5 shows the metal layer 400 pulling away from a substrate 308 at a lift line 504. In the embodiment shown, lift line 504 defines the border between the anchor region and an uplift region within the release region. As used herein, the lift line is defined as the series of points where metal layer 400 begins to curve out of the plane of the substrate. Mathematically, the lift line may be considered to be a series of points where the second derivative of the metal layer 400 surface becomes nonzero.

FIG. 6 shows a high conductivity material 600 coating metal layer 400. The coating improves the conductivity of the interconnect structure. Gold is one example of a high conductivity material that may serve as a coating, although other materials may also be used.

Figure 8:
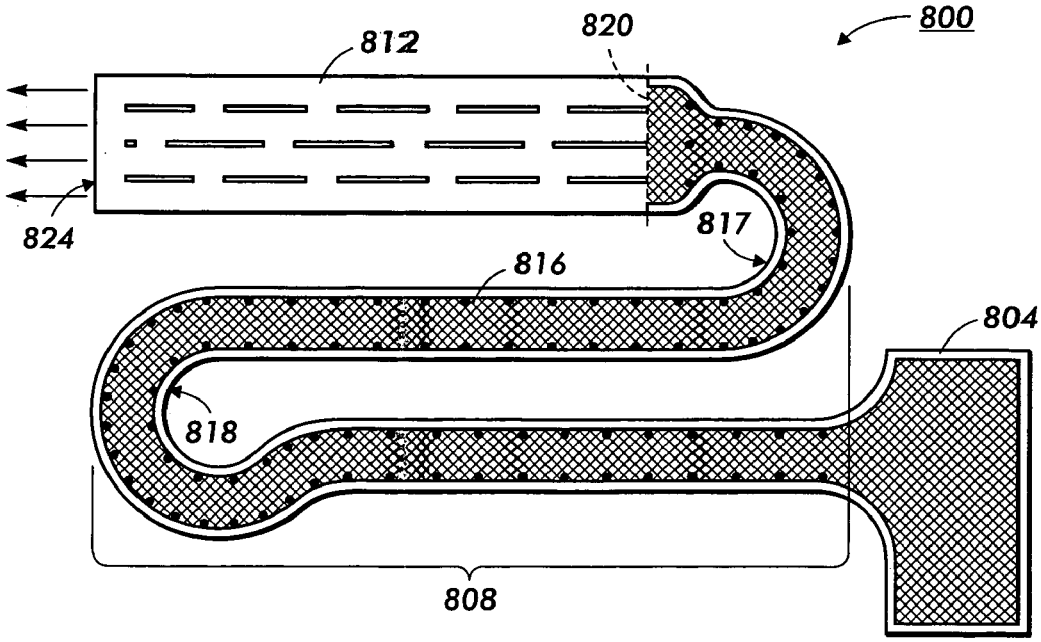
FIG. 8 shows a top view of one embodiment of an interconnect structure including a release portion that includes an uplift portion and a planar portion.

FIGS. 7–8 show top views of the interconnect structure. The shaded areas indicate the openings in the release photoresist. The views may be considered to be taken in an x-y plane, the plane of the substrate upon which the interconnect structure is formed. The z-axis represents a direction normal to the substrate. The views may also be considered as the photo masks used to form the interconnect structure.

FIG. 7 shows a simple version of interconnect structure 700 including an anchor portion 704 and a release portion 708. In the example of FIG. 7, the entire release portion curves out of the plane when the release layer is etched away. Slots 750, 754 in release portion 708 speeds up the release process by allowing etchant to flow underneath the spring.

In the illustrated embodiment, the total angle subtended by all in-plane curves in the uplift spring portion including in-plane curves 720, 724 is approximately zero degrees. Clockwise bends are again counted positive in this total angle, counter clockwise bends negative. Arranging the total angle subtended by all in-plane curves to sum to zero degrees results in an end tip portion 728 that is aligned and oriented perpendicular to the lift line 732. As used herein, the orientation of the tip is defined to be the direction of maximal curvature at the spring tip when the uplift portion 709 is curved out of the x-y plane. Thus the direction of maximal curvature 727 of end tip portion 728 is also oriented approximately perpendicular to lift line 732. As used herein, "perpendicular" in three dimensions does not mean that the lines necessarily intersect, instead it is defined to mean that a plane that includes the direction of maximal curvature forms a perpendicular angle with the lift line. As previously described, the lift line is the series of points across the spring at which the curvature out of the plane begins to become nonzero, in particular, where the second derivative of the metal surface becomes nonzero. Although the release layer underneath the stressed metal may be irregular etched to form an irregular release line defining where the spring decouples from the substrate, the lift line where the metal becomes curved will typically be a line.

In experimental results, the length 712 of the spring 700 is approximately 400 microns and the width 716 of the spring 700 is approximately 100 micron wide at the tip. Release portion 708 was lifted to an angle exceeding 45 degrees from the substrate. After lifting, the end subtips 744 and 756 remained within 5 microns of the same lift height above the substrate. Thus tip portion 728 remains in a plane approximately parallel to substrate 702 minimizing tip tilts. Typically, the tip tilt is kept to less than 10 degrees.

FIG. 8 shows a top view of an alternative interconnect spring structure 800. In the embodiments shown, spring structure 800 includes an anchor region 804 a release portion 808. Release portion 808 is further divided into an uplift portion 812 and a planar portion 816. Although the entire release portion 808 is decoupled from the underlying substrate, only the uplift portion 812 is curved out of the plane of the substrate plane. Planar portion 816 remains approximately in the plane of the substrate. However, planar portion 816 includes a meander that includes a plurality of in-plane curves 817, 818 that contribute to the lateral compliance of interconnect spring structure 800.

The series of points where the release portion begins to curve out of the plane defines lift line 820 [KVS8]. Lift line 820 approximately divides uplift portion 812 from planar portion 816 of the release portion. As. illustrated, when the in-plane curvatures in the uplifted portion of the release region (the portion beyond lift line 820 that curves out of the plane) nets to zero degrees, then the direction of maximal curvature, or the orientation of tip 824 is approximately perpendicular to lift line 820.

Figure 9:
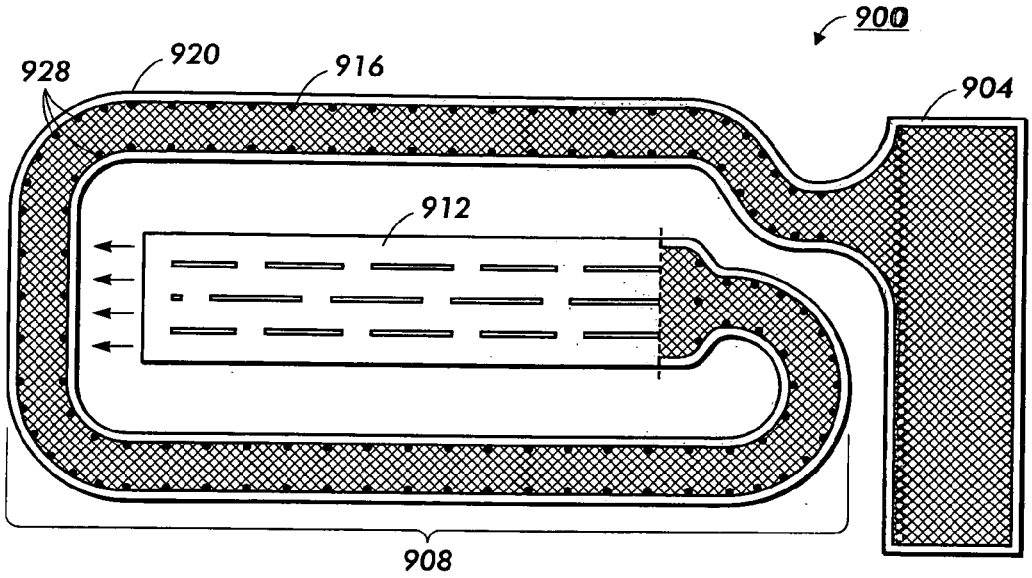
FIG. 9 shows a top view of a second embodiment of an interconnect structure including a release portion that include an uplift portion and a planar portion.

FIG. 9 shows an alternative embodiment. In interconnect spring structure 900 in FIG. 9, anchor 904 couples to a release portion 908. Release portion 908 further includes an uplift portion 912 and a planar portion 916. The in-plane curves in planar portion 916 provide lateral compliance without changing the spring elevation.

Figure 10:
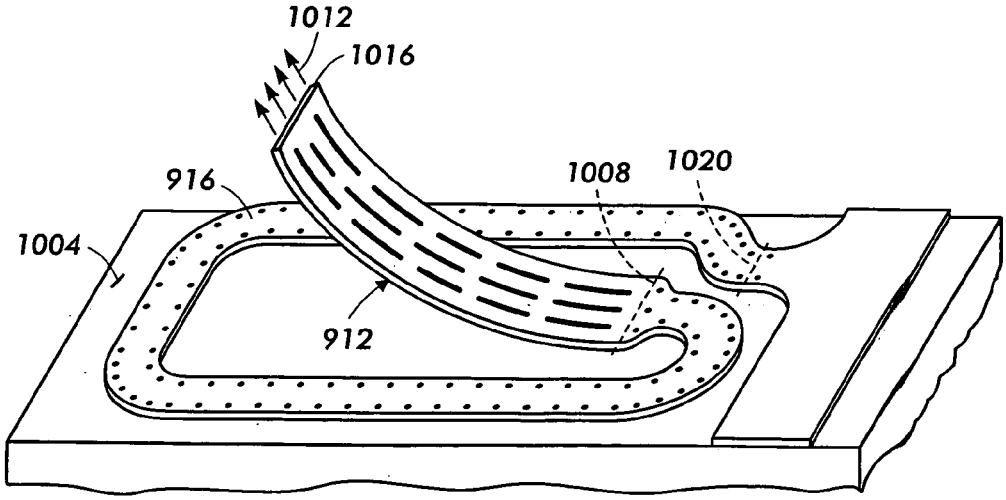
FIG. 10 shows an angled view of the structure of FIG. 9 with an uplift portion curved out of the plane of the substrate.

One method of preventing lifting of planar section 916 utilizes release photoresist overhanging an edge 924 of planar portion 916. When etching, etchant flows through perforations 928 or other apertures in planar portion 916. The etchant undercuts and releases planar portion 916 but the photoresist overhang 920 prevents uplifting of the metal. Plating interconnect structure 900 improves electrical conductivity. Plating also locks in the interconnect geometry; the plated metal is stiff enough to resist the stresses in the stressed spring metal and the planar portion 916 remains planar after photoresist removal. FIG. 10 shows the structure of FIG. 9 with a release line 1020 shown where the spring is released from substrate 1004. The release region also includes uplift portion 912 that curves out of the plane of substrate 1004. Lift line 1008 divides uplift portion 912 from planar portion 916 of the release region. The direction of maximal curvature, or spring tip 1016 orientation 1012 is approximately perpendicular to lift line 1008.

FIGS. 11–12 show still another embodiment of the invention to improve lateral spring compliance. In FIG. 11, spring structure 1104 includes a release portion 1108 coupled to an anchor portion 1112. Release portion 1108 has a median width 1116. As used herein, the "median width" is the width at which 50% of the length of the spring has a width that is wider or equal to the median width, and 50% of the length of the spring has a width that is less than or equal to the median width.

Release portion 1108 includes an aperture 1120 with a corresponding aperture width 1124. In the illustrated embodiment, the aperture width 1124 exceeds the median width 1116 of the spring. Flexible supports 1128 and 1132 surround an edge of aperture 1120 providing spring continuity.

In the illustrated embodiment, each flexible support 1128, 1132 is curved in the plane of the substrate.

FIG. 12 shows spring structure 1104 after removal of a release layer. After release layer removal, release portion 1108 curves out of the plane of substrate 1204. Lines 1208 indicate the orientation of the tip, otherwise referred to as the direction of maximal curvature of spring tip 1212. The direction of maximal curvature 1208 is approximately perpendicular to lift line 1222.

Figure 13:
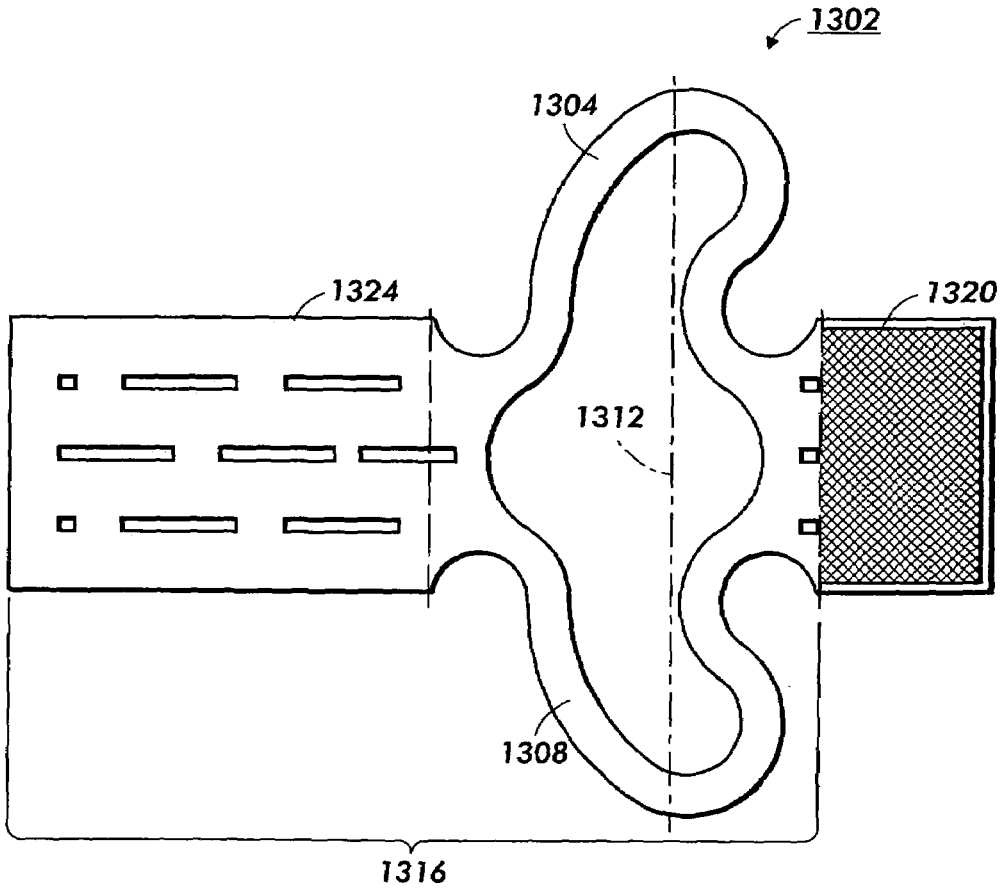
FIG. 13 shows a second embodiment of an interconnect structure including an aperture.

FIG. 13 shows a second embodiment of a spring 1302 with an aperture. In the embodiment of FIG. 13, the flexible support structures 1304, 1308 are longer than in flexible supports 1128, 1132 of FIG. 11. The shape of flexible supports 1304, 1308 may also be asymmetric along an axis 1312. In the illustrated embodiment, flexible supports 1304, 1308 are shaped to increase the weight of the release portion 1316 near anchor 1320. Distributing more weight near anchor 1320 adds clearance between the spring tip that solders to the mating circuit board pad and the aperture. The additional clearance helps avoid trapping solder in the aperture and thereby reducing the lateral spring compliance.

Figure 14:
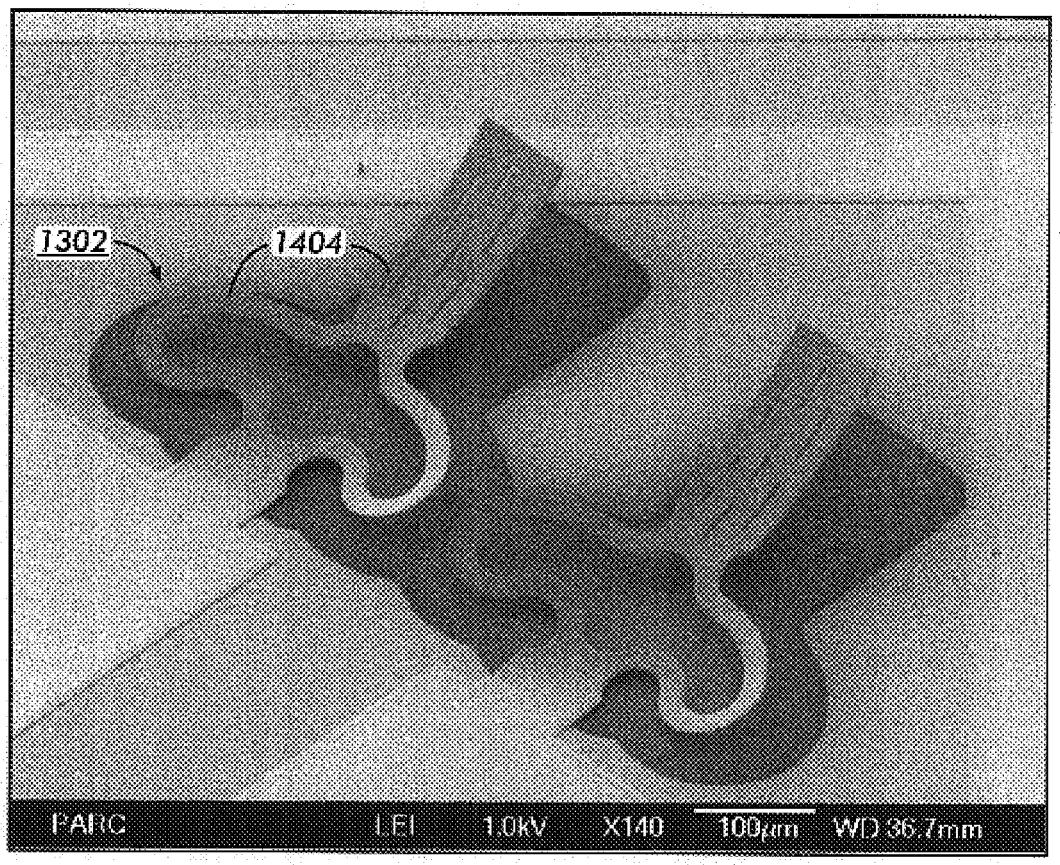
FIG. 14 shows an angled view of the structure of FIG. 13 that shows a release portion curved out of the plane of the substrate.

FIG. 14 shows the uplift of the release portion 1404 of spring 1302 after removal of the release layer.

A number of details have been provided in the drawings and the specification. These details have been provided to illustrate alternate uses and alternate methods for fabricating various embodiments of the inventions. These details should not be construed to define the scope of the invention. Instead, the scope of the invention should only be limited by the claims which follow.

What is claimed is:

1. An electrical circuit interconnect element comprising:

an anchor portion coupled to a substrate in a substrate plane;

a release portion including a first end coupled to the anchor portion, the release portion including a lift line where an uplift portion of the release portion begins a first curve that curves out of the plane of the substrate, the first curve in a plane approximately perpendicular to the lift line, the release portion further including a second curve wherein the second curve is not in the plane approximately perpendicular to the lift line; and, a curved spring tip coupled to a second end of the release portion, wherein the direction of maximal curvature of the curved spring tip lies in the plane approximately perpendicular to the lift line.

2. The electrical circuit interconnect element of claim 1 wherein the release portion is released from the substrate such that an internal stress gradient in the uplift portion causes the uplift portion to curve out of the plane of the substrate.

3. The electrical circuit interconnect element of claim 1 wherein the uplift portion includes a plurality of curves not in the plane approximately perpendicular to the lift line, said plurality of curves subtends an angle that totals approximately zero degrees.

4. The electrical interconnect element of claim 1 wherein the release portion is formed from one of molybdenum, tungsten, chromium, zirconium or nickel, or their alloys.

5. The electrical interconnect element of claim 1 wherein the anchor portions of the electrical interconnect is coupled to an integrated circuit.

6. The electrical interconnect element of claim 1 wherein the length of the uplift portion is less than 5 mm.

7. The electrical interconnect element of claim 1 wherein the spring tip is cut straight across, the spring tip remaining within 10 degrees of a plane parallel to the substrate plane.

8. The electrical interconnect element of claim 1 wherein the release portion includes a plurality of small openings to facilitate etching of a release layer.

9. The electrical interconnect element of claim 1 wherein the release portion is plated to increase stiffness.

10. The electrical circuit interconnect element of claim 1 wherein the second curve curves away from the anchor portion.

11. The electrical circuit interconnect element of claim 1 wherein the second curve is in a plane that is substantially parallel to the substrate plane, the second curve to substantially enhance a lateral compliance of the electrical circuit interconnect.

12. The electrical circuit element of claim 1 wherein the second curve second curve is in a plane substantially parallel to the substrate plane and wherein the second curve includes a curve segment that curves away from the anchor portion.

13. The electrical circuit interconnect of claim 1 wherein the release portion is formed from a stressed metal spring material including a stress gradient that includes a compressive stress in lower spring layers and a tensile stress in upper spring layers.

14. The electrical interconnect element of claim 1 wherein the release portion further comprises:

an unlifted portion.

15. The electrical interconnect element of claim 14 wherein the unlifted portion is prevented from uplifting during processing by a photoresist overhang.

16. The electrical circuit interconnect element of claim 1 wherein the release portion further includes a third curve wherein the third curve is not in the plane approximately perpendicular to the lift line and is curved in a different direction then said second curve.

17. The electrical circuit interconnect of claim 16 wherein the second curve and the third curve are in a plane that is substantially parallel to the substrate plane.

18. The electrical interconnect element of claim 1 wherein the release portion includes an aperture, the largest dimension of said aperture exceeding half the median width of the release portion.

19. The electrical interconnect element of claim 18 wherein the largest dimension of said aperture exceeds the median width of the release portion.

20. The electrical interconnect element of claim 18 wherein the aperture includes a plurality of flexible support structures on either side of the aperture, the flexible support structures curved in the plane of the substrate prior to release of the uplift portion.

21. An electrical interconnect element comprising:

an anchor portion coupled to a substrate; and, a flexible stressed metal forming a release portion, first end of the release portion coupled to the anchor portion, the release portion including at least one in-plane curved section wherein the in-plane curved section is in a plane approximately parallel to a surface of the substrate, the release portion also including an uplift portion; and, a curved spring tip coupled to a second end of the release portion, wherein the direction of maximal curvature of the curved spring tip lies in a plane approximately perpendicular to the lift line.

22. The electrical interconnect element of claim 21 wherein the uplift portion includes no curves that are not in a plane approximately perpendicular to a lift line.

23. The electrical interconnect element of claim 21 wherein the release portion includes a lift line, a direction of maximum curvature at a curved tip of the release portion oriented approximately perpendicular to the release line.

24. The electrical interconnect element of claim 21 wherein the release portion is plated with a material to improve conductivity.

25. The electrical interconnect element of claim 21 wherein the release portion further comprises a planar portion.

26. The electrical interconnect element of claim 25 wherein the planar portion is prevented from uplifting during processing by a photoresist overhang.

27. The electrical interconnect element of claim 25 wherein the length of the uplift portion is between 0.1 micrometer and 5 mm and the width is between 0.02 micrometer and 1 mm.

28. The electrical interconnect element of claim 21 wherein the in-plane curves are on either side of an aperture in the release portion.

29. The electrical interconnect element of claim 28 wherein the lamest dimension of the aperture is over 50% of the median width of the release portion.

30. The electrical interconnect element of claim 28 wherein the width of the aperture exceeds the median width of the release portion.

31. The electrical interconnect element of claim 29 further comprising:

a first flexible supports on a first side of the aperture, the first flexible support having a width less than 49% of the average width of the spring; and, a second flexible support on a second side of the aperture, the second flexible support having a width less than 49% of the average width of the spring.

32. An electrical interconnect element comprising:

an anchor portion anchored to a substrate in a substrate plane; and, a stressed metal spring including a stress gradient that includes a compressive stress in lower spring layers and a tensile stress in upper spring layers coupled to the anchor portion, the spring including an aperture in the spring, the entire perimeter of the aperture bounded by spring material, the largest dimension of the aperture exceeding 50% of the width of the spring, and, a tip coupled to an end of the stressed metal spring and oriented by the stress gradient such that the direction of maximal curvature at the spring tip is non-parallel to the substrate plane.

33. The electrical interconnect element of claim 32 wherein the width of the aperture is at least 0.05 micrometer.

34. The electrical interconnect element of claim 32 wherein the width of the aperture exceeds the average width of the spring.

35. The electrical interconnect element of claim 32 further comprising:

a first flexible supports on a first side of the aperture, the first flexible support having a width less than 49% of the average width of the spring; and, a second flexible support on a second side of the aperture, the second flexible support having a width less than 49% of the average width of the spring.

36. An electrical circuit interconnect element comprising:

an anchor portion coupled to a substrate in a substrate plane;

a release portion including a first end coupled to the anchor portion, the release portion including at least a first in-plane curve and a second in-plane curve, the first in-plane curve curving in a different direction than the second in-plane curve, both the first in-plane curve and the second in-plane curves in a plane approximately parallel to the substrate plane, the release portion further including a lift line where an uplift portion of the release portion begins to curve out of the plane of the substrate; and, a spring tip coupled to a second end of the release portion, and wherein the direction of maximal curvature at the spring tip lies in a plane approximately perpendicular to the lift line.

* * * * *